US008585470B2

(12) United States Patent
Farber

(10) Patent No.: US 8,585,470 B2
(45) Date of Patent: Nov. 19, 2013

(54) WEARABLE BACKING FOR AN ABRASIVE FLAP DISK

(75) Inventor: Donald W. Farber, Towson, MD (US)

(73) Assignee: Black & Decker Inc., Newark, DE (US)

( * ) Notice: Subject to any disclaimer, the term of this patent is extended or adjusted under 35 U.S.C. 154(b) by 547 days.

(21) Appl. No.: 12/887,857

(22) Filed: Sep. 22, 2010

(65) Prior Publication Data

US 2012/0071073 A1 Mar. 22, 2012

(51) Int. Cl.
*B24D 13/04* (2006.01)

(52) U.S. Cl.
USPC ..... 451/466; 451/490; 451/495; 451/534; 451/537

(58) Field of Classification Search
USPC ..... 451/465, 466, 468, 490, 495, 532, 533, 451/534, 537; 15/230.12, 230.15; 428/105, 428/107, 109, 110, 113, 170, 171, 172
See application file for complete search history.

(56) References Cited

U.S. PATENT DOCUMENTS

| | | | | |
|---|---|---|---|---|
| 5,752,876 | A * | 5/1998 | Hettes | 451/463 |
| 5,951,389 | A * | 9/1999 | Hettes et al. | 451/508 |
| 6,786,812 | B2 * | 9/2004 | Stuckenholz et al. | 451/490 |
| 6,863,596 | B2 * | 3/2005 | Fritz et al. | 451/59 |
| 6,945,863 | B1 * | 9/2005 | Hettes | 451/490 |
| 7,794,309 | B2 * | 9/2010 | Wendt-Ginsberg et al. | 451/466 |
| 8,246,425 | B2 * | 8/2012 | Schudel | 451/466 |
| 2002/0177391 | A1 * | 11/2002 | Fritz et al. | 451/59 |
| 2004/0048560 | A1 * | 3/2004 | Wendt-Ginsberg et al. | 451/466 |

FOREIGN PATENT DOCUMENTS

DE 3741279 6/1989

* cited by examiner

*Primary Examiner* — Timothy V Eley
(74) *Attorney, Agent, or Firm* — Adan Ayala; Amir Rohani

(57) ABSTRACT

A structure for a backing plate of an abrasive disk is disclosed. The structure includes layers of abrasive resin interspersed with layers of reinforcing fiberglass. The layers are generally disk shaped and cover certain radial intervals of the entire backing plate between the inner diameter and the outer diameter. For example, a radial stress profile plotting the stress along a radial line from inner to outer diameter can be determined. The amount and radial positioning of reinforcing layers (e.g., reinforcing fiberglass) may then be determined. An appropriate amount of reinforcing layers may then be placed within the radial intervals that experience the highest stress.

20 Claims, 7 Drawing Sheets

WEARABLE BACKING FOR AN ABRASIVE FLAP DISK

FIELD OF THE INVENTION

The present invention relates to a device for preparing the surface of an object (e.g., a metal surface). More particularly, the present invention discloses an improved structure for a wearable backing plate of a rotary abrasive disk.

BACKGROUND

In one method of finishing a surface, an abrasive disk is fitted to a rotating shaft of a power tool. The power tool rotates the disk which is urged against the surfaced to be finished. The rotating disk has an abrasive surface which contacts and prepares the surface as desired by the user. As an example, a power tool such as a grinder, may be fitted with such an abrasive wheel to prepare pipe surfaces before welding on those surfaces.

One type of grinding disk, a flap disk, includes a backing plate and a series of flexible, overlapping, abrasive flaps attached to an outer periphery of the backing plate. The flaps are usually made from a cloth material which includes either an aluminum oxide grain or a zirconium-aluminum oxide grain adhered to the surface of the cloth material. The flaps are the primary surface preparation medium and the backing plate provides a structure on which to support the rotating flaps. U.S. Pat. Nos. 5,752,876 and 6,945,863 disclose similar flap disk wheels and their disclosures are incorporated by reference herein in their entirety.

As the flaps wear away during use, a portion of the backing plate may come into contact with the work piece. As a result, the abrasive disk works most effectively when the backing plate also wears as it contacts the work piece. Furthermore, the backing plate must transfer (i.e., without breaking) a load applied by the user from its inner diameter where the backing plate is secured to its outer diameter to which the flaps are secured. In other words, the backing plate must be composed of a material capable of withstanding normal internal operational stresses without breaking while, at the same time, it must be composed of a sufficiently wearable material.

Fiberglass is a material used to strengthen backing plates. Specifically, fiberglass (e.g., woven or nonwoven) can be positioned to absorb tensile loads experienced in a backing plate. However, in some applications, fiberglass does not wear cleanly. Resin-abrasive mix, which is also used in wearable back plates, on the other hand, wears cleanly, but does not have sufficient strength for some applications. There is therefore a need to develop a backing plate structure that wears at about the same rate as the flaps and that wears cleanly.

SUMMARY

Generally, the present specification discloses a wearable backing plate structure. The structure includes multiple layers of wearable materials that are specifically positioned within various predetermined radial intervals of the backing plate. At least one type of the wearable material is in the form of a layer of strengthening glass material (e.g., fiber glass) while another type of the wearing material is in the form of a layer of wearable resin-abrasive mixed material.

The layers of glass are primarily for strengthening the structure. As the structure is pressed against a work piece and loaded, internal stresses vary radially from the inner diameter to the outer diameter. The invention provides for radially locating various amounts of reinforcing glass in the backing plate structure at the radial intervals that experience relatively large internal stresses. Furthermore, as the wheel, and therefore the backing plate, bends with the applied load, the bottom of the wheel tends to experience larger tensile stresses relative to the top of the wheel. Reinforcing glass can therefore be concentrated toward the bottom of the backing plate to accommodate those stresses.

BRIEF DESCRIPTION OF THE DRAWINGS

FIGS. 5(*g*)-(*j*) are cross-section views of FIGS. 5(*c*)-(*f*) respectively at a different grind angle than FIGS. 5(*c*)-(*f*).

Like reference numerals have been used to identify like elements throughout this disclosure.

DETAILED DESCRIPTION

Figure 1:
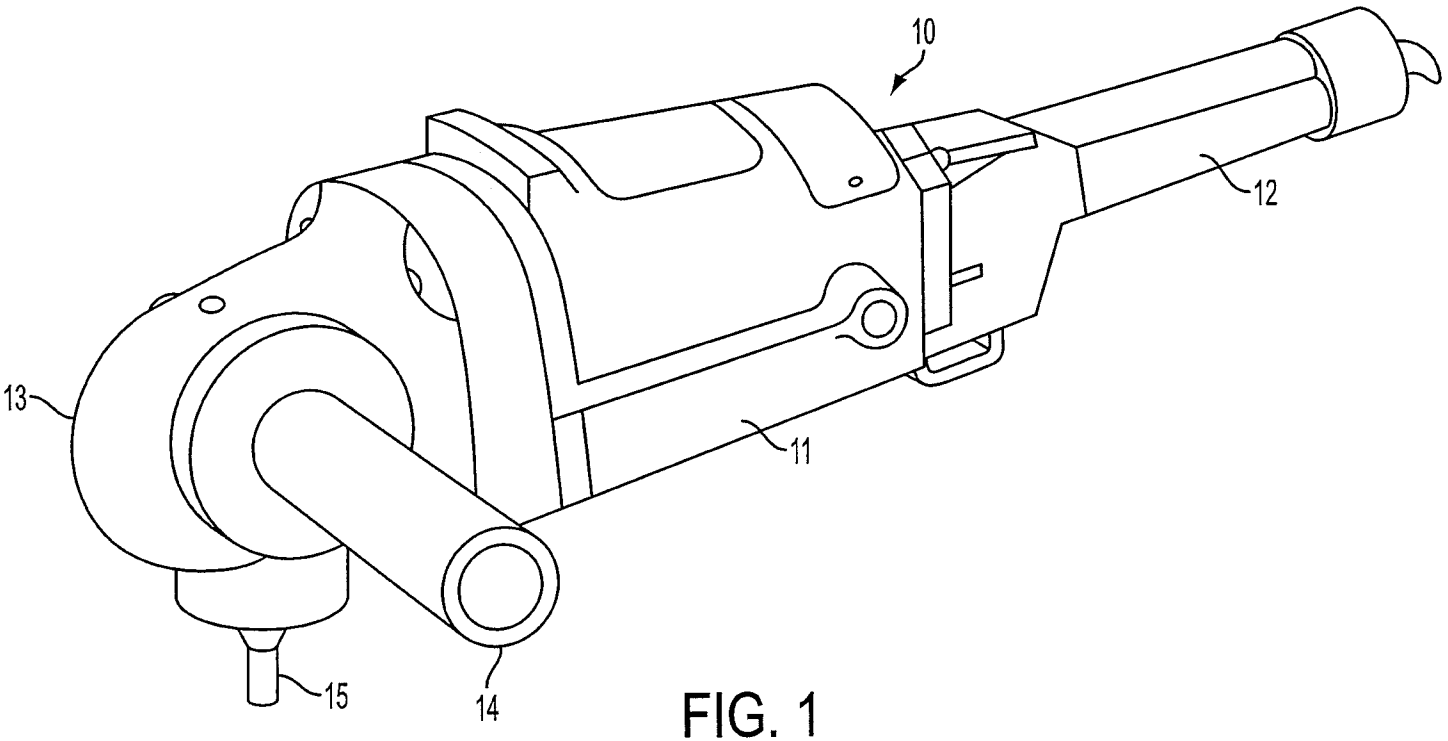
FIG. 1 illustrates a perspective view of an exemplary power tool for use with the abrasive disk of the present invention.

Referring now to FIGS. 1-4, FIG. 1 illustrates a perspective view of an exemplary rotary power tool on which the present invention may be mounted. Specifically, FIG. 1 illustrates a portable electric grinder 10 with which the teachings of the present disclosure may be explained. It will be appreciated by those skilled in the art, however, that grinder 10 is only exemplary of a wide variety of rotary power tools to which the present teachings may be applied. With this in mind, grinder 10 generally comprises a motor housing 11, a switch handle 12, a gear case 13, an auxiliary handle 14, and a right-angle spindle 15 for mounting a grinding wheel assembly 16 (shown best in FIG. 4) or other tool element assembly. For the sake of clarity, no grinder guard is shown. Spindle 15 is externally threaded and has an annular shoulder 15A (FIG. 4) formed thereon.

Figure 4:
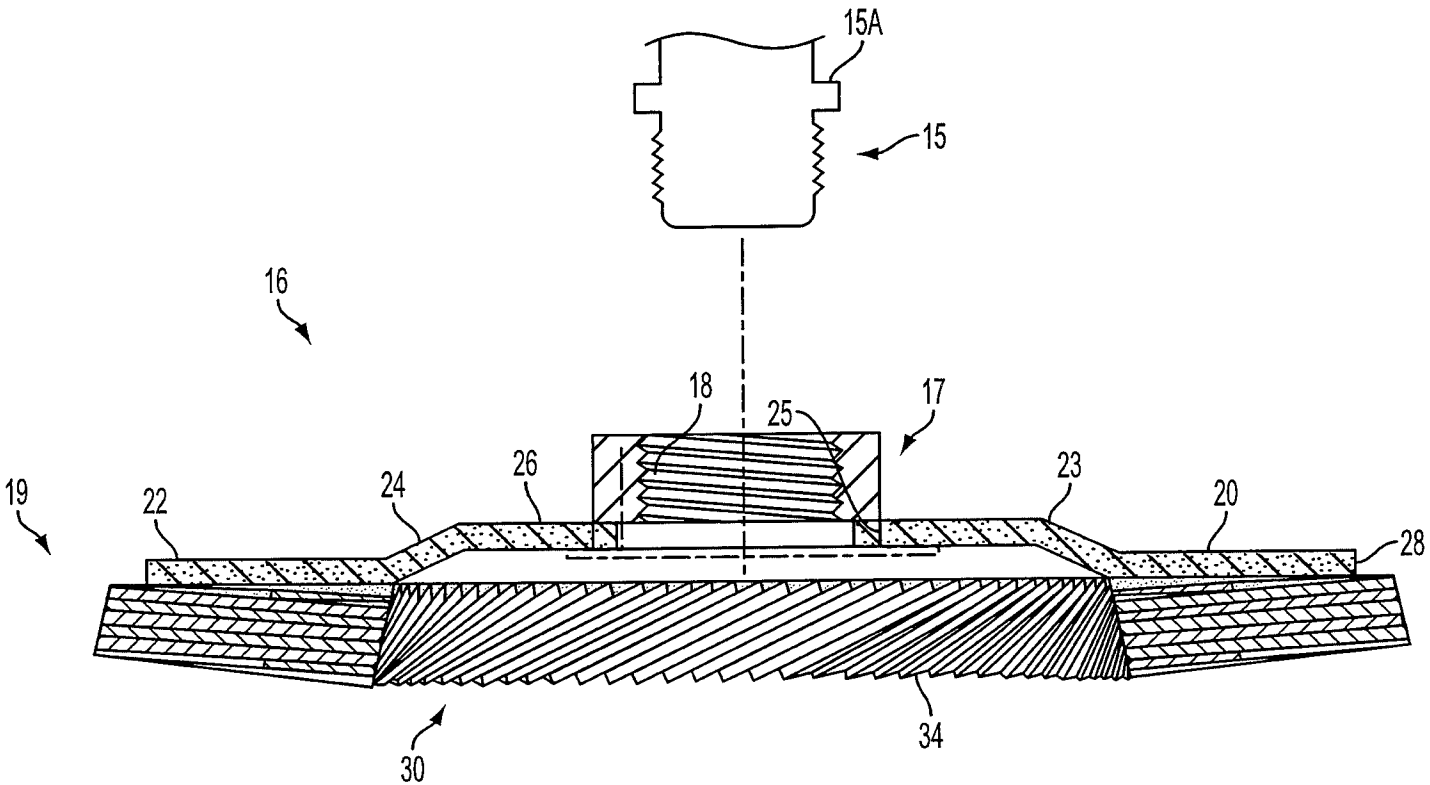
FIG. 4 illustrates a cross-sectional exploded view of the mechanism of FIG. 2.

As seen in FIG. 4, a tool element assembly, or abrasive disk assembly 16 can be threadably mounted on spindle 15. The abrasive disc assembly 16 includes a depressed center surface finishing or abrasive disk 19 that is coupled to an internally threaded hub assembly 17

Figure 2:
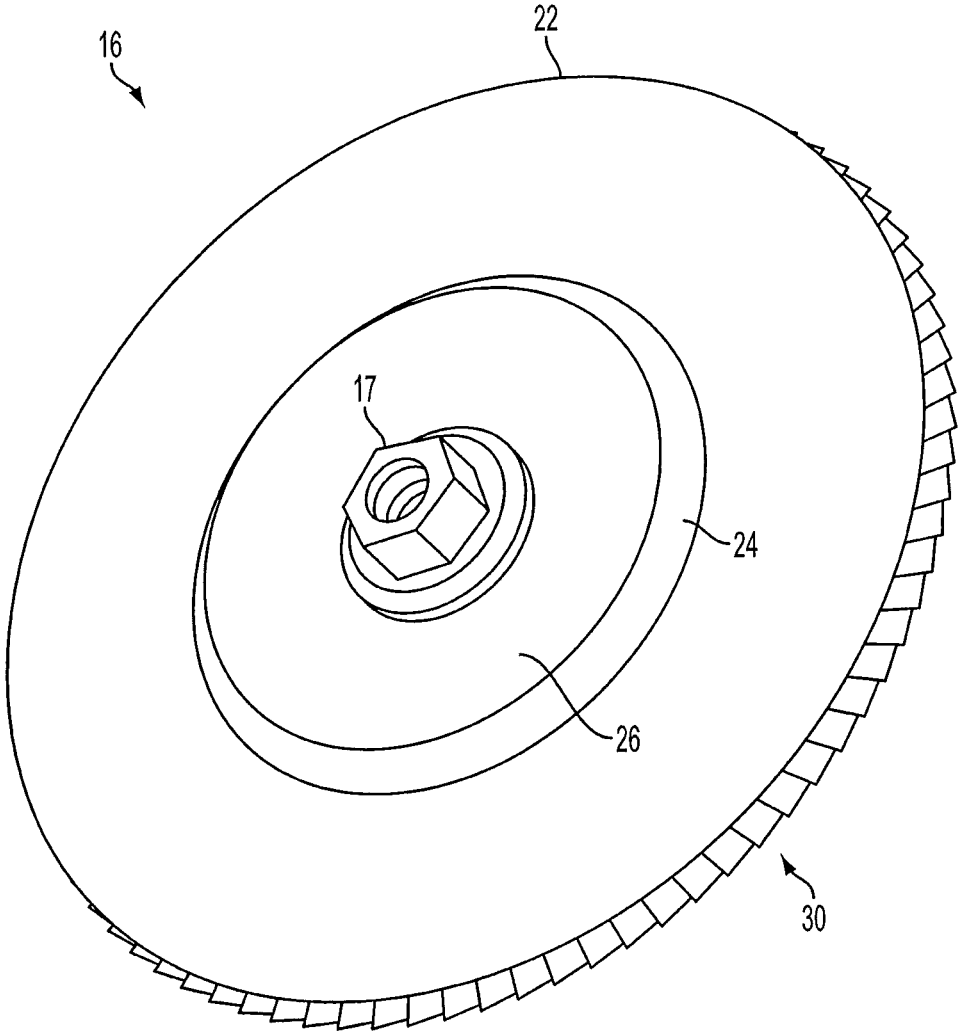
FIG. 2 illustrates a perspective view of an embodiment of an abrasive disk of the present invention.
Figure 3:
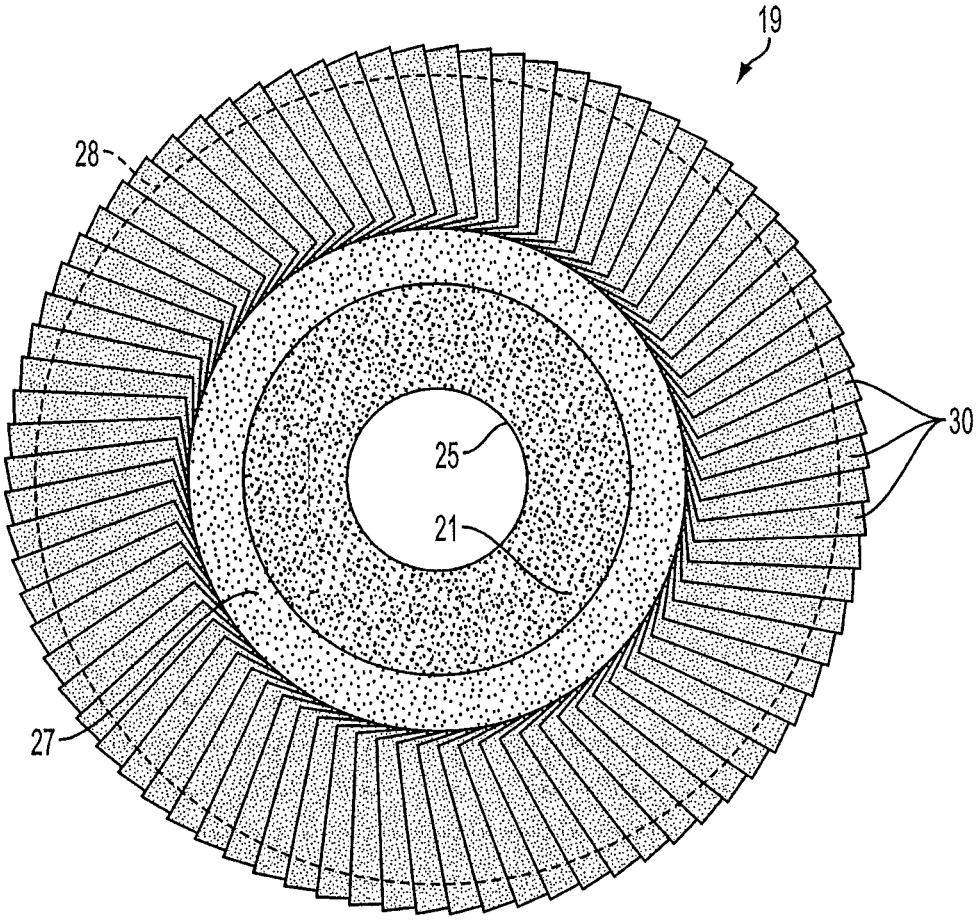
FIG. 3 illustrates a bottom view of the abrasive disk of FIG. 2.

FIGS. 2-4 illustrate abrasive disk assembly 16 of the present invention. Specifically, FIG. 2 illustrates a top perspective view of abrasive disc assembly 16 according to the present invention, which may be used with a rotary surface finishing tool (e.g., a grinder 10). FIG. 3 shows a bottom view of disk assembly 16. Specifically, hub assembly 17 includes an internally threaded aperture 18 which receives externally threaded spindle 15 of grinder 10. Spindle 15 extends through aperture 18 to accommodate a fastener (not shown) with which abrasive disc 16 is fastened to spindle 15. Rotational motion is transmitted from spindle 15 to abrasive disk 19 through hub assembly 17.

Abrasive disc 19 includes a backing plate 20 that has an aperture 25 that is formed centrally in backing plate 20 for attaching abrasive disc 19 to hub assembly 17. Aperture 25 defines an abrasive disk inner radius. Abrasive disc 19 also includes a plurality of abrasive flaps 30, also known as sandpaper flaps. The flaps 30 are generally manufactured from a cloth or paper material and are coated with an abrasive grain or grit. Ordinarily, aluminum oxide grain or a zirconium-aluminium oxide grain is used. This provides the abrasive surface for grinding purposes. Each flap 30 is connected to a bottom outer surface of abrasive disk 19 and each overlaps an adjacent flap around the periphery of abrasive disc 19 as shown in FIGS. 1-4. Rotation of abrasive disc 19 in contact with a work surface (not shown), causes abrasive flaps 30 to sand or abrasively wear away the work surface.

Referring now to FIG. 4, backing plate 20 is generally of a circular configuration. Backing plate 20 has a desired diameter of about between 100-200 mm. Ordinarily backing plate 20 also has a desired thickness of about between 3-5 mm. Backing plate 20 includes abrasive grains 21 applied into the backing material. The abrasive grains 21 may be any type of abrasive grains such as the aluminum oxide or zirconium aluminum oxide or others such as blast media. Preferably, the grains 21 are any type of friably or semi-friably sized material. A bonding agent generally of phenolic resins, epoxies, phenol epoxies or other organic bonding agents may be utilized to secure the abrasive grains with a woven fiberglass material 23.

Backing plate 20 is manufactured by laying alternate layers of fiberglass and grinding wheels mixture material 27 upon one another. The fiberglass material 23 may be coated with the bonding agent and abrasive grain 21 material. These glass layers (discussed further in FIG. 6) are then pressed under a high pressure tonnage to form a uniform body. Backing plate 20 is clamped into shaped plates and cured using a heat process.

Backing plate 20 has a planar portion 26 within which aperture 25 is defined. Planar portion 26 extends outward from aperture 25 to a stepped portion or offset portion 24. Offset portion 24 is adjacent to and extends away from planar portion 26 toward an annular, planar flange or wearing flange 22. Offset portion 24 is configured to position wearing flange 22 a predetermined radial and axial distance away from spindle 15 of grinder 10. Various modifications of the design of backing plate 20 are contemplated within the general scope of the invention. For example, while an offset portion 24 as described above may be utilized, planar portion 26 and wearing flange 22 may lie along substantially the same plane. Those skilled in the art will understand and appreciate the diverse backing plate configurations which may be practiced within the scope of this invention.

Regarding flaps 30, a portion of the inner surface 32 of each abrasive flap 30 is attached to wearing flange 22 by means of an adhesive. The adhesive is also composed of a material that wears away as it rotationally contacts a work piece. Outer surface 34 of flap 30 is positioned at an angle with respect to the plane defined by wearing flange 22.

Figure 5A:
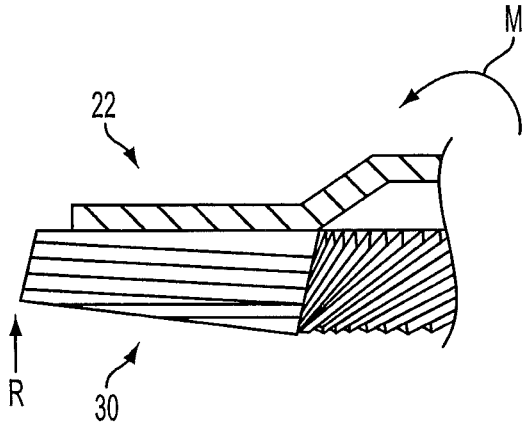
FIG. 5A illustrates a cut away view of a portion of the abrasive disk of FIG. 2 showing some of the external forces experienced during operation.
Figure 5B:
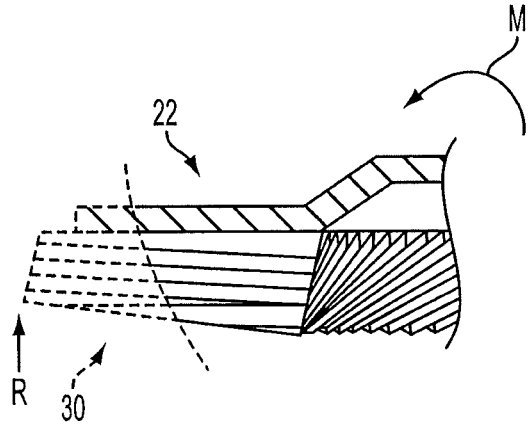
FIG. 5B illustrates a cut away view of a portion of the abrasive disk of FIG. 2 showing a worn away portion of the abrasive disk in phantom.
Figure 5C:
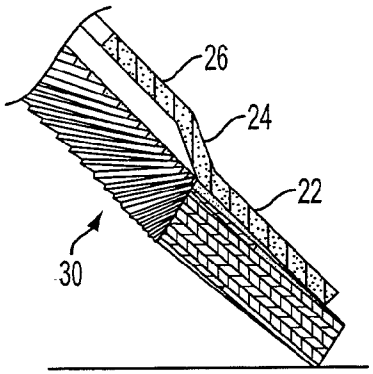
FIGS. 5(*c*)-(*f*) are cross-section views of the flap disc of FIG. 4 during different stages of a grinding process.
Figure 5D:
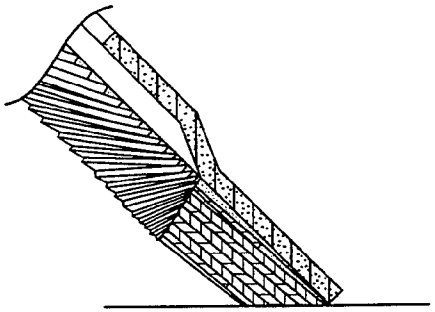
Figure 5E:
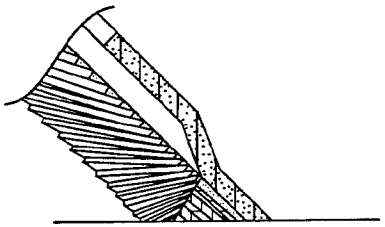
Figure 5F:
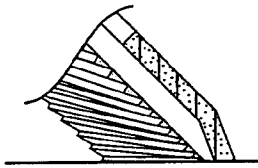
Figure 5G:
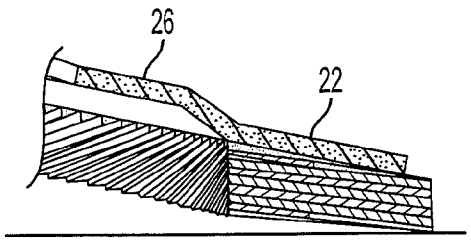
Figure 5H:
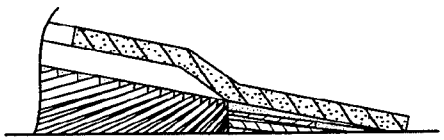
Figure 5I:
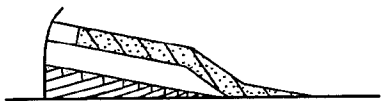
Figure 5J:
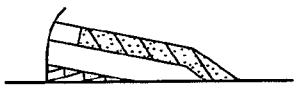

Disk performance is directly related to friction generated between the disk and the work piece. This friction is in turn directly related to the amount of force a user applies at grinder 10. In other words, the more force M a user applies to disk 19, the more friction can be generated as the abrasive disk rotates. Application of force M by a user also necessarily generates an internal radial stress profile along backing plate 20. FIG. 5A shows the forces responsible for generating wearing friction that ultimately define a disk's wear profile. A moment force M is applied by a user via grinder 10 with work piece reactionary force R helping to balance the forces involved. FIG. 5B illustrates an end portion of disk 19 showing a worn away portion of disk 19. The worn away portion is in phantom to define a typical wear profile. Actual wear profiles may vary depending on the loads and angles applied by the user during operation.

As flaps 30 wear away, backing plate 20 is eventually exposed to the work piece (not shown). Backing plate 20 is made from a fiber-reinforced resin matrix material which has abrasive particles imbedded therein in the same way as they are in grinding wheels. This mix can be composed so that backing plate material wears away at about the same rate as flaps 30 wear away and so that backing plate 20 does not damage the work piece.

Thus, the wearing flange 22, including the abrasive grain material, continues to abrade the surface to be ground as flaps 30 continues to wear during use. Referring to FIGS. 5(*c*)-(*f*) and 5(*g*)-(*j*), as can be seen, flap disc 19 has its flaps 30 contact the surface at a desired grind angle (FIG. 5(*c*)) up to a point where wearing flange 22 contacts the surface to be ground (FIG. 5(*d*)). Backing plate 20, including the abrasive grains, as well as flaps 30, continue to grind the surface (FIG. 5(*e*)). The backing plate 20 and flaps 30 continue to wear during grinding of the surface until flaps 30 are extinguished (FIG. 5(*f*)). As can be seen in FIGS. 5(*c*)-(*f*), the grind angle of the flap disc 19 remains constant during the entire use of the flaps 30. FIGS. 5(*g*)-(*j*) are like FIGS. 5(*c*)-(*f*) with flap disc 19 at a different grind angle. This is unlike the prior art wherein flap disc 19 must be constantly adjusted in order to compensate for the fact that flaps 30 cannot be used while backing plate 20 contacts the surface.

Fiber-reinforced resin mix (e.g., a resin mix reinforced with fiberglass) is a solution to at least two backing plate design requirements. First, backing plate 20 must wear with flaps 30. Second, backing plate 20 must be sufficiently strong to withstand the internal stresses generated by normal operational loadings (i.e., operator load M). Glass tensile stresses for the disclosed arrangements are typically effective at a strength of at least 2200 Newtons/50 mm. Lower strength glass may be used where external loads will be less.

The effectiveness of backing plate wear is a function of the placement and proportion of glass and abrasive resin mix in the plate design. While glass is a thin, strong, layered material that is effective in tensile reinforcement, fiberglass can wear less cleanly than the resin mix. In fact, when the mix is disproportionately more highly concentrated with fiberglass, fiberglass strands remain unworn and sometimes melt and burn producing a mess on the work piece and/or an undesirable odor. Resin mix, on the other hand, which includes abrasive particles, grinds away more cleanly. However, in some applications and designs, un-reinforced resin mix can have insufficient strength (e.g., tensile strength). On the other hand, when fiberglass is combined in proper layered proportion to the abrasive particle resin, the resin can interact with the fiberglass to wear the fiberglass more cleanly. Specifically, the rough abrasive characteristics of the resin serve to sever glass fibers more effectively. The result is a strong efficiently wearing backing plate.

In addition to wearing cleanly, the glass must be arranged in the plate to absorb operating stress. Typically, the fiberglass portion of backing plate 20 provides strengthening (i.e., tensile strength) to maintain its structural integrity (i.e., so backing plate 20 does not break) during operation. When a load M is applied to disk 19, reinforcing glass can be positioned in backing plate 20 where stresses (e.g., tensile) are highest. Placement of glass along the thickness of the wheel is most effective in the bottom portion of backing plate 20 since the bottom of the wheel experiences tensile stresses as it is pressed against a work piece. In addition, glass is positioned in the backing plate within certain radial intervals that experience the highest internal stresses.

Because it is not required that planar portion 26 and offset portion 24 wear during operation, more strengthening fiberglass may be added to these areas than to wearing flange 22. Furthermore, Applicant has determined that, during operation, backing plate 20 experiences some of its highest internal stresses in the area (i.e., radial interval) of offset portion 24. As a result, additional fiber reinforcement can be positioned radially between aperture 25 and a radius just pass offset portion 24. More specifically, because the fiber is incorporated into backing plate 20 in layers, the layers of fiberglass in the area around aperture 25, need only extend outward to a truncated position just past offset portion 24. In other words, lower internal stresses call for less fiberglass being needed between the outer diameter of backing plate 20 and the truncated fiber glass layers. Because wearing flange 22 is the only portion of backing plate 20 that wears, and because backing plate 20 experiences relatively lower operational stresses toward its outer diameter, resin mix and fiberglass can be proportioned to ensure clean wearing at about the same rate as flap disks 30.

Figure 6A:
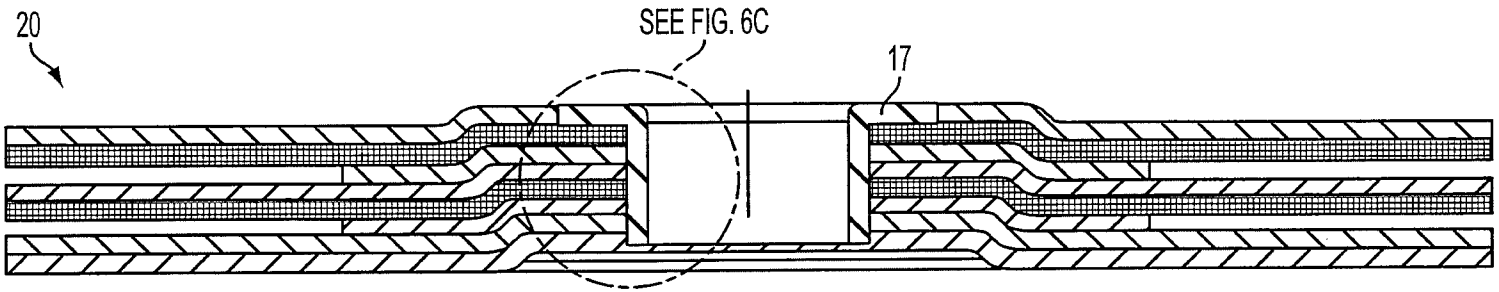
FIG. 6A illustrates an enlarged cut away view of a backing plate of the abrasive disk of FIG. 4 showing individual layers.
Figure 6C:
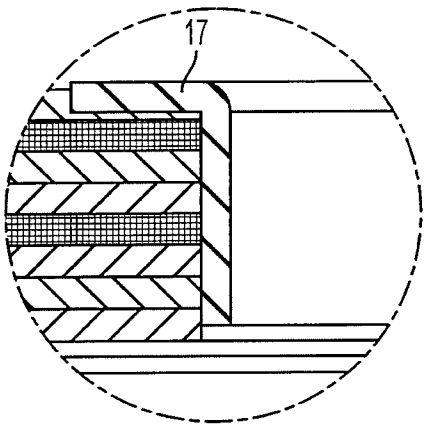
FIG. 6C illustrates an enlarged cut away view of an inner diameter portion of the abrasive disk of FIG. 4.
Figure 6B:
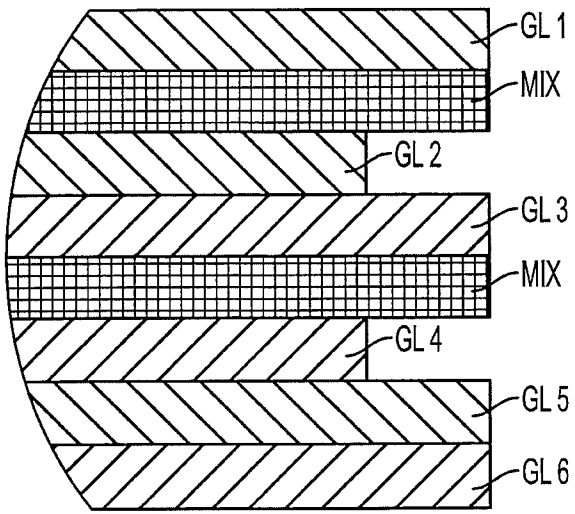
FIG. 6B illustrates an enlarged cut away view of an outer diameter portion of the abrasive disk of FIG. 4.

FIGS. 6A-6 illustrate an enlarged exemplary backing disk 20 on a simplified hub assembly 17. The thickness of backing plate 20 is exaggerated to show individual layers (i.e., glass layers (GL 1-6) and two (2) resin mix layers). FIG. 6B illustrates the general arrangement of the layers showing that certain layers (e.g., fiberglass layers GL2 and GL4) may be truncated relative to the outer diameter of backing plate 20 and relative to other layers (e.g., G1). Again, to illustrate the truncated layers, the plate thickness is exaggerated and a space is shown adjacent to the truncated layers. This space does not actually exist. The two layers adjacent to the space actually touch and are bonded to each other. FIG. 6A illustrates the general arrangement of the layers showing an exemplary arrangement of the inner diameter of the layers relative to simplified hub assembly 17.

The result of the foregoing structure is that the radial positioning of reinforcing material within reinforcing layers is non-uniform so that reinforcing material in at least one layer is radially located in a position where no reinforcing material is found in another layer. Furthermore, even if the reinforcing structure is not specifically a layered structure, it can be said that the radial positioning of reinforcing material is non-uniform along the thickness (i.e., from the bottom of the backing plate 20 where flaps 30 are connected to the opposite side) of the backing plate. This means that reinforcing material extends within some radial interval at one thickness, while at another thickness, no reinforcing material exists within that same radial interval.

A variety of layer arrangements may be utilized. However, the general arrangement shown in FIG. 6 provides significant glass tensile reinforcement on the bottom toward GL 6 while providing upper resin mix layers that serve to sever undesirable GL 5 and GL6 strands. Glass layer GL 4 is truncated and will not extend to the wearing flange 22. Therefore, the illustrated arrangement allows the abrasive disk 19 to wear effectively, and at the same time, provides for a sufficiently strong abrasive disk that a user can apply significant force to the disk 19 for effective grinding.

While the parameters and designs set forth therein lead to backing plates of satisfactory performance, those skill in the art will appreciate that variations of the principles disclosed herein may be applied to achieve other satisfactory outcomes. For example, the present invention also contemplates a backing plate that includes strands of varying strength, positioned in various positions about the plate.

The invention claimed is:

1. An abrasive disk assembly comprising:

an abrasive disk including a backing plate having a radius, a bottom and a thickness, the backing plate including a wearing flange, a planar portion and an offset portion that locates the wearing flange and the planar portion in parallel, offset planes;

a hub assembly attached within a central aperture of the planar portion;

wherein the backing plate is composed of a reinforcing material having a thickness and a resin-abrasive mix, the reinforcing material being positioned in reinforcing layers along the thickness of the backing plate from the bottom to a top of the backing plate, wherein a layer of the reinforcing material extends outward to the offset portion but not to the backing plate outer diameter, and wherein the thickness of the reinforcing material is non-uniform along the radius of the backing plate.

2. The abrasive disk assembly of claim 1, wherein most of the reinforcing material is positioned toward the bottom of the backing plate.

3. The abrasive disk assembly of claim 1, further comprising a plurality of abrasive flaps attached to a bottom of the wearing flange.

4. The abrasive disk assembly of claim 1, wherein less reinforcing material is positioned toward an outer radius of the backing plate than toward an inner radius of the backing plate.

5. The abrasive disk assembly of claim 1, wherein, the radial positioning of reinforcing material is non-uniform along the thickness of the backing plate.

6. The abrasive disk assembly of claim 1, wherein the reinforcing material is glass.

7. The abrasive disk assembly of claim l, wherein the reinforcing material is a woven or non-woven fiberglass.

8. A backing plate having a radius, a bottom and a thickness comprising:

a wearing flange, a planar portion and an offset portion that locates the wearing flange and the planar portion in parallel, offset planes;

a central aperture defined in the planar portion; wherein the backing plate is composed of a reinforcing material having a thickness and a resin-abrasive mix, the reinforcing material being positioned in reinforcing lavers along the thickness of a the backing plate from the bottom to a top of the backing plate, wherein a layer of the reinforcing material extends outward to the offset portion but not to the backing plate outer diameter, and wherein the thickness of the reinforcing material is non-uniform along the radius of the backing plate.

9. The backing plate of claim 8, wherein most of the reinforcing material is positioned toward the bottom of the backing plate.

10. The backing plate of claim 8, further comprising a plurality of abrasive flaps attached to a bottom of the wearing flange.

11. The backing plate of claim 8, wherein less reinforcing material is positioned toward an outer radius of the backing plate than toward an inner radius of the backing plate.

12. The backing plate of claim 8, wherein, the radial positioning of reinforcing material is non-uniform along the thickness of the backing plate.

13. An abrasive disk assembly comprising:

an abrasive disk including a backing plate having a radius, a bottom and a thickness, the backing plate including a wearing flange, a planar portion and an offset portion that locates the wearing flange and the planar portion in parallel, offset planes;

a hub assembly attached within a central aperture of the planar portion;

wherein the backing plate is composed of a reinforcing material having a thickness and a resin-abrasive mix, the reinforcing material being positioned in reinforcing layers along the thickness of the backing plate from the bottom to a top of the backing plate, and wherein the thickness of the reinforcing material is non-uniform along the radius of the backing plate, wherein the radial positioning of reinforcing material within reinforcing layers is non-uniform so that reinforcing material in at least one layer is radially located in a position where no reinforcing material is found in another layer.

14. The abrasive disk assembly of claim 13, wherein the backing plate further includes an offset portion that locates the wearing flange and the planar portion in parallel, offset planes.

15. The abrasive disk assembly of claim 13, wherein most of the reinforcing material is positioned toward the bottom of the backing plate.

16. The abrasive disk assembly of claim 13, further comprising a plurality of abrasive flaps attached to a bottom of the wearing flange.

17. The abrasive disk assembly of claim 13, wherein less reinforcing material is positioned toward an outer radius of the backing plate than toward an inner radius of the backing plate.

18. The abrasive disk assembly of claim 13, wherein the reinforcing material is a woven or non-woven fiberglass.

19. The abrasive disk assembly of claim 13, wherein, the radial positioning of reinforcing material is non-uniform along the thickness of the backing plate.

20. The abrasive disk assembly of claim 13, wherein the reinforcing material is one of the group consisting of glass, woven fiberglass and non-woven fiberglass.

* * * * *